US008448360B2

(12) United States Patent
Guo et al.

(10) Patent No.: US 8,448,360 B2
(45) Date of Patent: May 28, 2013

(54) FLAP SENSOR ACTIVATED GREETING CARDS

(75) Inventors: Jerry Guo, Shanghai (CN); Tiger Qiao, Shanghai (CN); David Sapp, Avon Lake, OH (US); Beth Laverdiere, Rocky River, OH (US); Johnathan Talbot, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/198,758

(22) Filed: Aug. 5, 2011

(65) Prior Publication Data

US 2012/0055053 A1 Mar. 8, 2012

Related U.S. Application Data

(60) Provisional application No. 61/370,914, filed on Aug. 5, 2010.

(51) Int. Cl.
*G09F 1/04* (2006.01)

(52) U.S. Cl.
USPC ..... 40/124.03

(58) Field of Classification Search
USPC ..... 40/124.03, 455, 906, 717; 446/147
See application file for complete search history.

(56) References Cited

U.S. PATENT DOCUMENTS

| | | | | |
|---|---|---|---|---|
| 4,299,041 | A | 11/1981 | Wilson | |
| 5,257,823 | A | 11/1993 | Colvin et al. | |
| 7,240,442 | B2 | 7/2007 | Clegg | |
| 7,647,718 | B2 * | 1/2010 | Burtch | 40/539 |
| 7,780,588 | B2 | 8/2010 | Clegg | |
| 7,861,441 | B1 | 1/2011 | Hoellwarth | |
| 2005/0227214 | A1 | 10/2005 | Clegg | |
| 2006/0185201 | A1 | 8/2006 | Fachon et al. | |
| 2007/0151131 | A1 | 7/2007 | Clegg | |
| 2007/0256337 | A1 | 11/2007 | Segan | |
| 2009/0314668 | A1 | 12/2009 | Miller et al. | |
| 2010/0089985 | A1 | 4/2010 | Fusaro | |
| 2010/0164836 | A1 | 7/2010 | Liberatore | |
| 2010/0199530 | A1 * | 8/2010 | Sapp et al. | 40/124.03 |
| 2010/0230481 | A1 | 9/2010 | Emmott | |

FOREIGN PATENT DOCUMENTS

| | | |
|---|---|---|
| WO | WO2010105041 | 9/2010 |
| WO | WO2010151568 | 12/2010 |

* cited by examiner

*Primary Examiner* — Joanne Silbermann
(74) *Attorney, Agent, or Firm* — Christine A. Flanagan

(57) ABSTRACT

The interactive flap sensor activated greeting card of the present invention contains an audio module and a series of "window flaps" across the inside of the greeting card. When the greeting card is opened, a short audio prompt instructs the user to open a series of flaps inside the card to hear further audio messages or sound clips that correlate with the art work inside the card. When each flap is opened, a different audio file is played. The sound module is programmed to react to the card opening and then to trigger additional individual sounds each time one of the flaps of the card is opened. In another embodiment, the greeting card contains a series of flaps wherein opening one flap reveals another flap, and so on. Once the last flap is opened, a short audio recording is activated.

7 Claims, 7 Drawing Sheets

FLAP SENSOR ACTIVATED GREETING CARDS

RELATED APPLICATIONS

This application claims priority to U.S. Provisional Patent Application Ser. No. 61/370,914, filed on Aug. 5, 2010, which is incorporated herein in its entirety.

FIELD OF THE INVENTION

The present invention is in the field of social expression products, and more specifically to interactive greeting cards.

BACKGROUND OF THE INVENTION

Greeting cards are widely used for celebratory occasions such as birthdays, graduations, weddings, and for other social expression purposes. Traditional text information is generally found on paper greeting cards. Sound generating devices have been incorporated into traditional paper greeting cards to increase entertainment value and emotional impact. In some forms, a talking or musical greeting card looks just like a conventional greeting card, except that it includes a hidden sound module. Opening the greeting card will automatically turn on or close a switch so that the sound module will play the pre-stored music or dialog and closing the greeting card will automatically open the switch and stop the play of the music or dialog.

SUMMARY OF THE INVENTION

In one embodiment, the interactive greeting card of the present invention includes a greeting card body having a plurality of panels attached along a plurality of fold lines, the plurality of panels forming at least one cavity therebetween and at least one of the plurality of panels having one or more flaps contained thereon; a sound module operative to store and playback at least one digital audio file, the sound module located within the at least one cavity; a slide switch operative to initiate playback of a first digital audio file upon opening the greeting card; and one or more activation mechanisms operative to initiate playback of one or more digital audio files upon lifting the one or more flaps.

In another embodiment, the interactive greeting card includes a greeting card body having at least three greeting card panels with two of the at least three panels forming a cavity therebetween; a flap contained on one of the at least three greeting card panels; a sound module operative to store and playback at least one digital audio file, the sound module located inside the cavity formed by two of the at least three greeting card panels; and a three-panel insert having three sub-panels connected along two fold lines and arranged so that each of the three sub-panels are in a stacked arrangement, the three sub-panels each having a flap contained thereon. When the flap contained on one of the at least three greeting card panels is opened, a first flap on a first sub-panels is revealed and when the first flap is opened, a second flap on a second sub-panel is revealed. When the second flap is opened, a third flap on a third sub-panel is revealed and when the third flap is opened, playback of the at least one digital audio file is initiated.

DETAILED DESCRIPTION OF PREFERRED AND ALTERNATE EMBODIMENTS

The flap sensor activated greeting cards of the present disclosure and related inventions are interactive greeting cards having an audio module and a series of "window flaps" contained on the greeting card body. When each flap is opened or lifted, a different sound or audio message is activated. As used herein, the term "message" or "audio message" is used to refer to a recorded verbal or spoken message, word or phrase, a recorded music sample or clip, recorded sound effect, or other audio recording.

The body of the greeting card includes a plurality of greeting card panels connected along various fold lines. The greeting card panels may be made of paperboard, cardboard, or any other suitable material. At least two greeting card panels overlap or are otherwise in face-to-face contact with each other and attached, adhesively or otherwise, along at least three edges thereby forming a cavity therebetween. The greeting card panels may be substantially rectangular, as the examples and figures describe, or they may be of various other shapes and sizes. Various electronic components of the greeting card may be contained and concealed within the one or more cavities.

Figure 8:
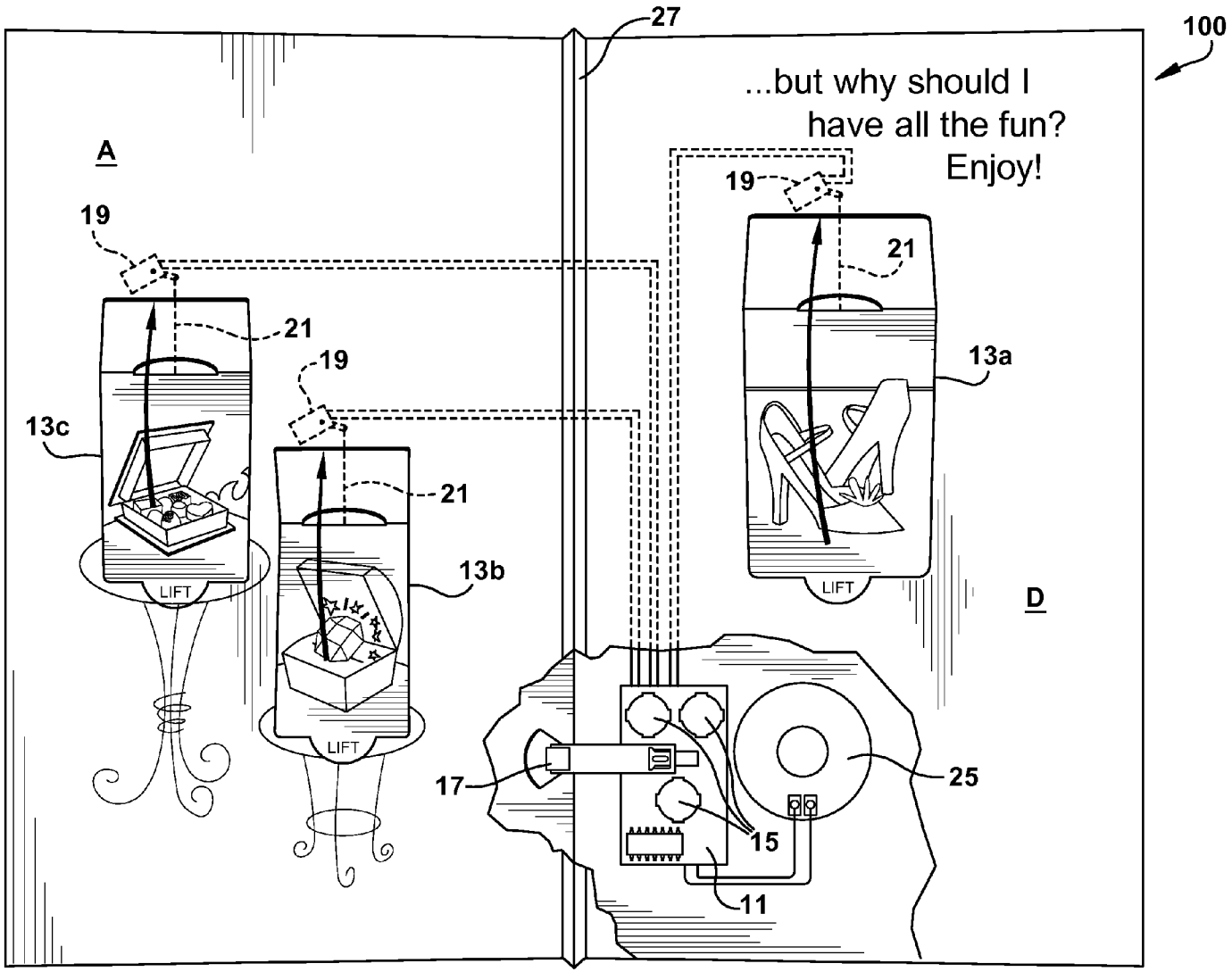
FIG. 8 is a front inside view of a second embodiment of the greeting card of the present invention with all flaps in an open position.
Figure 9:
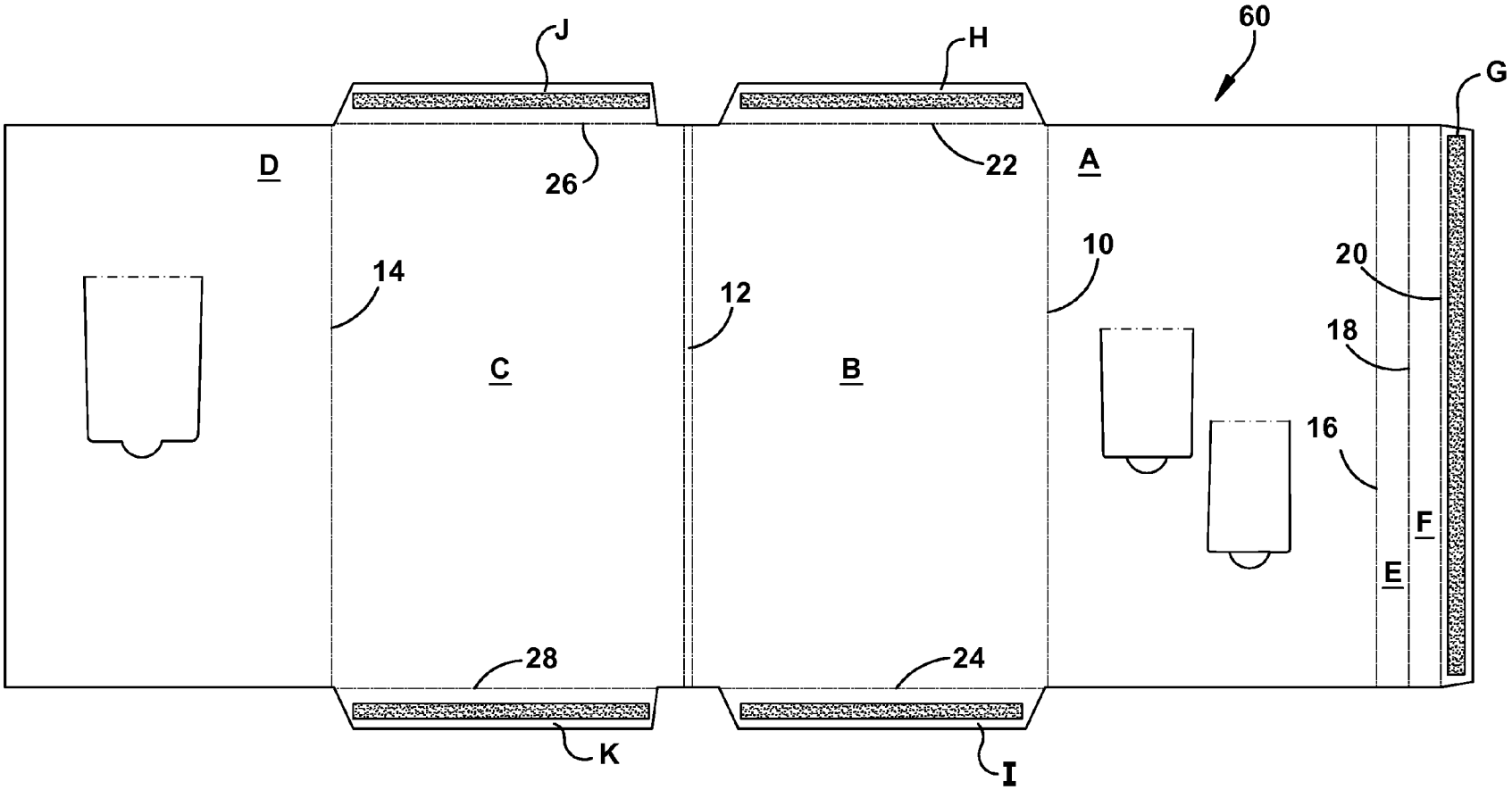
FIG. 9 is a front view of the panels or body of the greeting card of FIG. 8.

In one embodiment, indicated generally at reference numeral 100 and shown in FIGS. 8 and 9, the greeting card body 60 includes four main greeting card panels. A first main panel A is connected to a second main panel B along a first fold line 10. The second main panel B is connected to a third main panel C along a second fold line 12 and the third main panel C is connected to a fourth main panel D along a third fold line 14. The first main panel A is connected along a vertical edge (opposite the vertical edge connecting main greeting card panels A and B) to a first tab E along fold line 16. First tab E is connected to a second tab F along fold line 18 and second tab F is connected to third tab G along fold line 20. The inside surface of tab G contains an adhesive strip used in attaching tab G to main panel D. Tabs E, F and G are folded and attached to the main greeting card panels to create an inner spine 27, that conceals the wires running from each flap sensor or activation mechanism located on each inside panel of the greeting card to the main circuit board 11, which is concealed beneath one of the inside panels of the greeting card. Main panel B is connected to horizontal tab H along fold line 22 along an upper edge of main panel B and to horizontal tab I along fold line 24 along a lower edge of main panel B. Both tabs H and I have an adhesive strip attached thereto for attachment to other panels. Likewise, main panel C is connected to horizontal tab J along fold line 26 located along an upper edge of main panel C and to horizontal tab K along fold line 28, located along a lower edge of main panel C. Both tabs J and K have an adhesive strip attached thereto for attachment to other panels. There may be one or more flaps 13*a*, 13*b*, 13*c* contained on panels A and/or D. Main panel A serves as the left inside panel of the greeting card 100 and main panel D serves as the right inside panel of the greeting card 100. The one or more flaps 13*a*, 13*b*, 13*c* are contiguous with main panels A and/or D, and in the embodiment shown, are substantially square or rectangular in shape having three side edges which are severed from main panels A and/or D and one side edge which is still connected to main panels A and/or D. The one or more flaps 13*a*, 13*b*, 13*c* are maintained in a first or closed position, wherein the surface behind the flaps is concealed by the flaps. The flaps can be moved to a second or open position by pivoting the flap about a fold line or the one side edge which is connected to main panels A and/or D. When a flap is in the second or open position, the surface behind the flap is revealed to the user, as shown in FIG. 8. The surface below the flap may contain a printed message or a picture, drawing or other artwork. Lifting the flaps may also trigger a special effect such as an audio recording (described in further detail below). The area of main panels A and/or D which surrounds the flap may contain a cutout such as a half circle, which can be used to facilitate the opening of the flap by, for example placing ones thumb or finger into the cutout to grip and open the flap. The flaps may open in an upward direction, a downward direction, or the flaps may open from left-to-right or from right-to-left.

Figure 1:
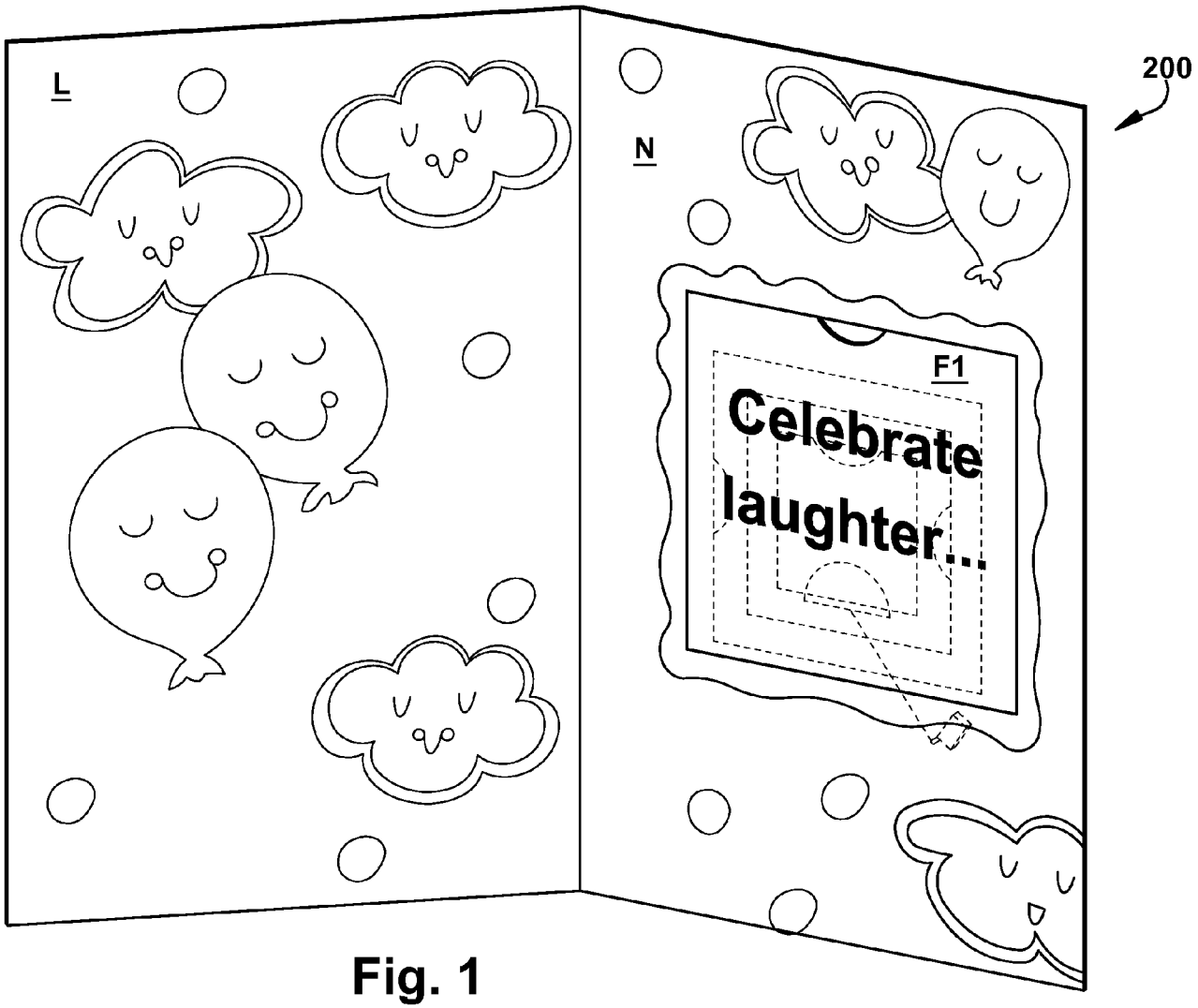
FIG. 1 is a perspective view of the inside of a first embodiment of the greeting card of the present invention with all flaps in a closed position.
Figure 2:
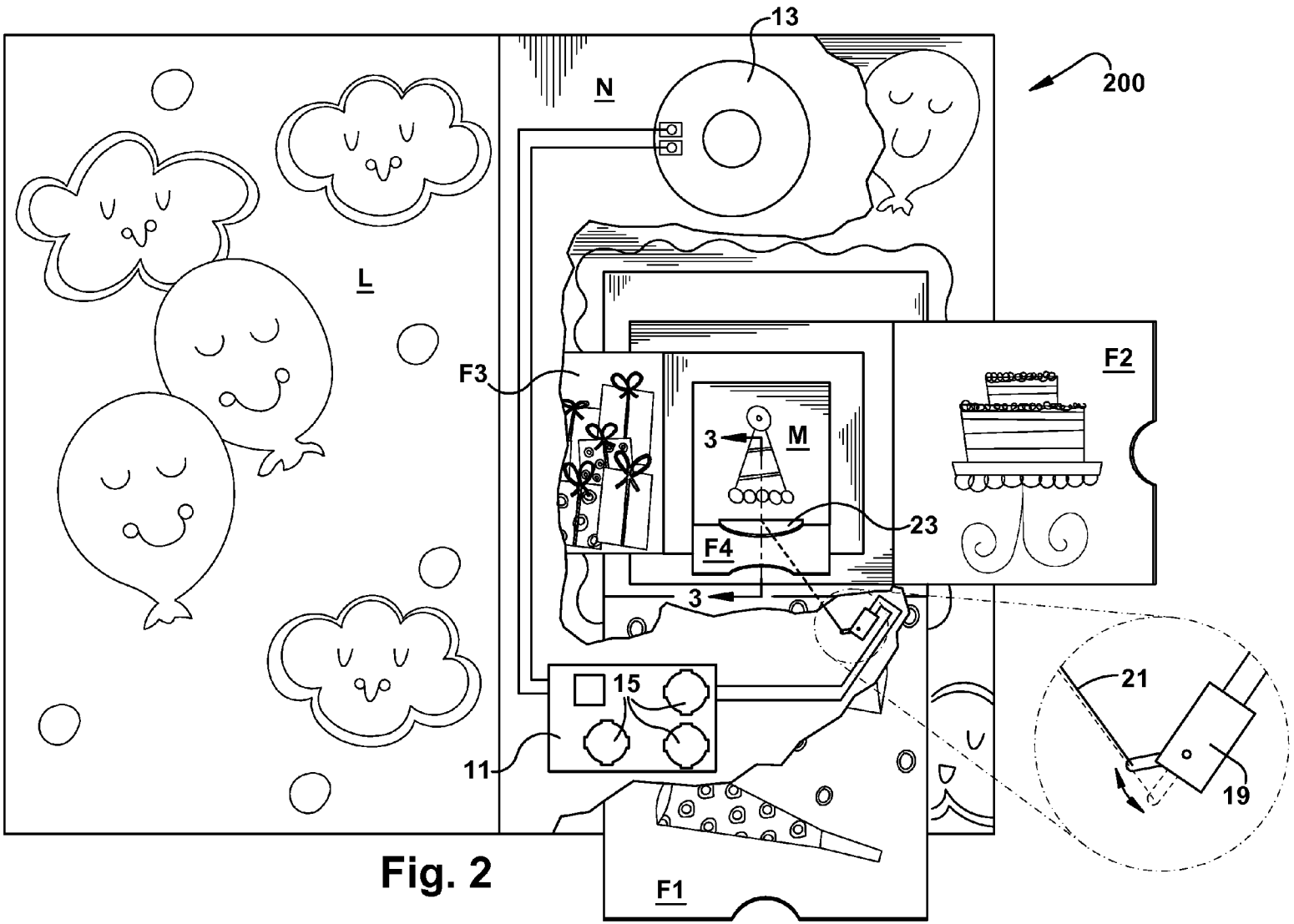
FIG. 2 is a tear away view of the inside of the greeting card of FIG. 1, with all flaps in an open position.
Figure 4:
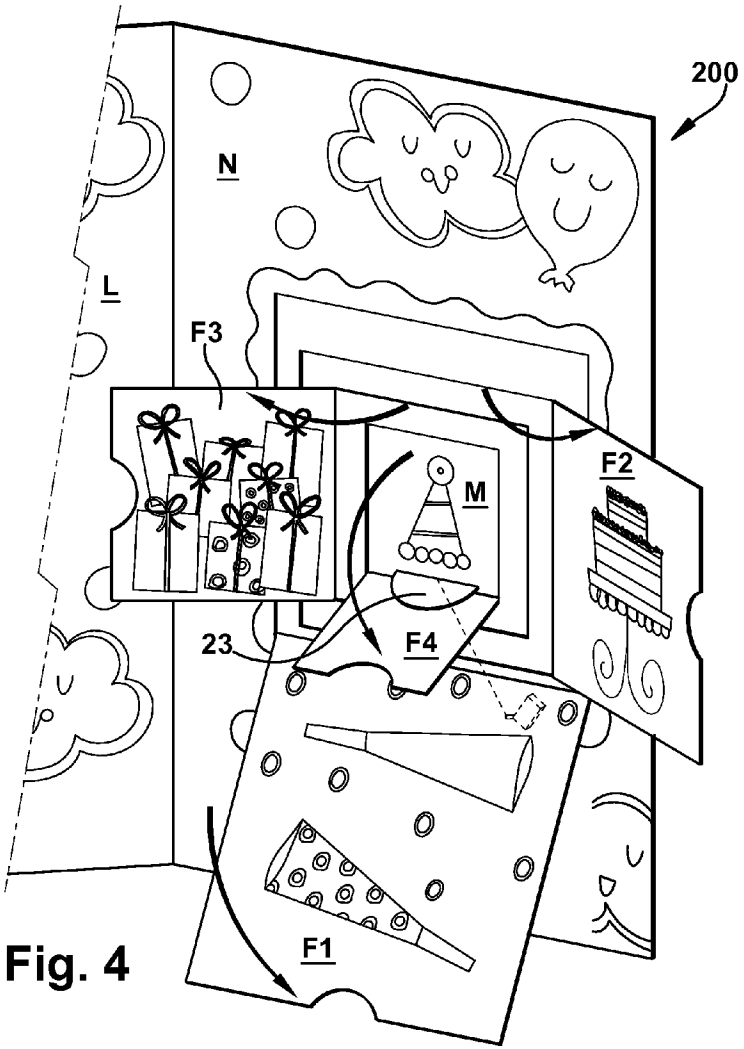
FIG. 4 is an perspective view of the inside of the greeting card of FIG. 1 with all flaps in an open position.
Figure 3:
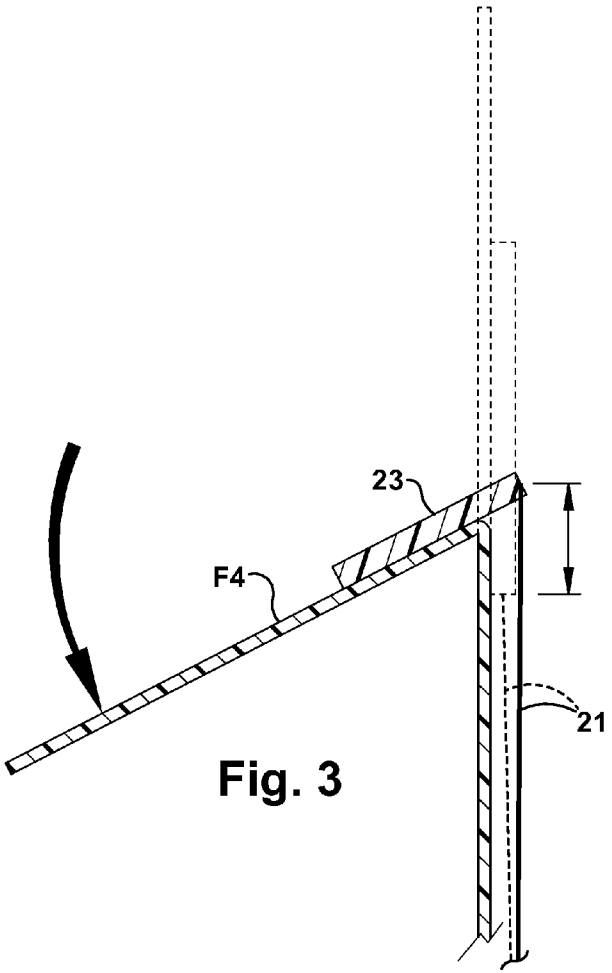
FIG. 3 is a side view of a portion of the greeting card of FIG. 2 along lines 3-3.
Figure 5:
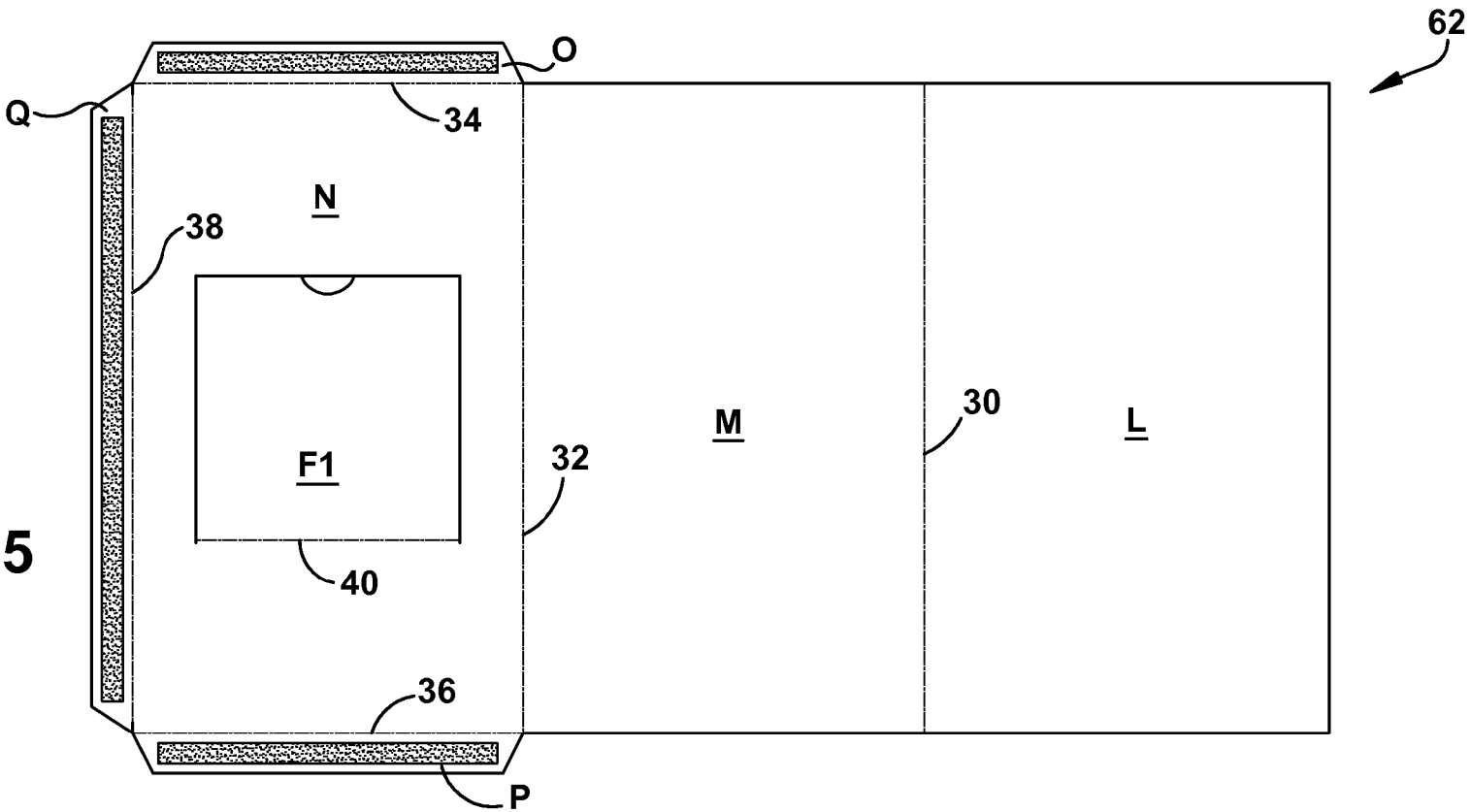
FIG. 5 is a front view of the panels or body of the greeting card of FIG. 1.
Figure 6:
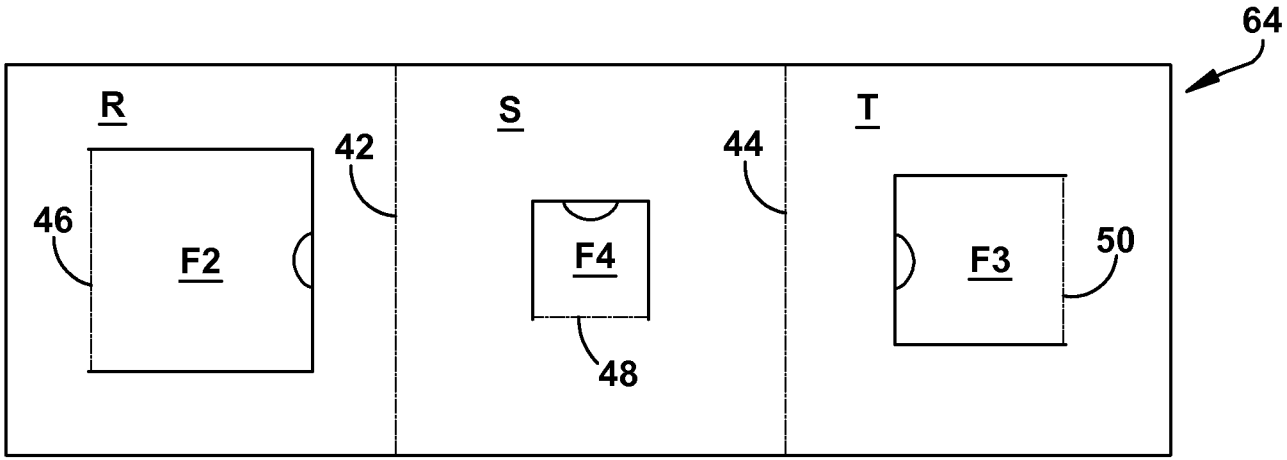
FIG. 6 is the inside surface of an inner panel containing three sub-panels which is contained within the greeting card of FIG. 1.
Figure 7:
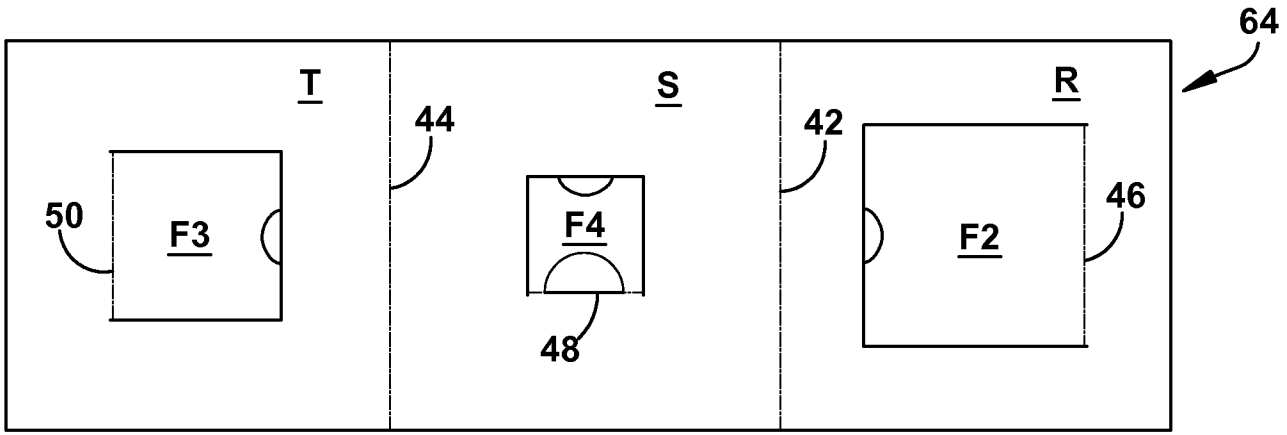
FIG. 7 is the outside surface of the inner panel of FIG. 6.

In another embodiment, indicated generally at reference numeral 200 and shown in FIGS. 1-7, the main greeting card body 62, shown in FIG. 5, includes three main greeting card panels L, M, N. The first main panel L is attached to the second main panel M along fold line 30 and the second main panel M is attached to the third main panel N along fold line 32. Main panel N is attached to a horizontal tab O along fold line 34, located along an upper edge of main panel N, to horizontal tab P along fold line 36, located along a lower edge of main panel N, and to vertical tab Q along fold line 38, located along a vertical side edge of main panel N directly opposite fold line 32. Tabs O, P and Q each have an adhesive strip attached thereto for attaching main panel N to main panel M. Main panel N has a flap F1 contained thereon. Flap F1 is substantially square shaped and integral with main panel N, having three sides which are unattached and one side which is connected to main panel N along fold line 40. The flap F1 contains a arched or half-circle cutout along one edge to facilitate opening the flap F1 by rotating the flap F1 about fold line 40. Flap F1 is maintained in a first or closed position, wherein the surface beneath flap F1 is concealed by flap F1. Pivoting flap F1 downward about fold line 40, reveals the surface beneath flap F1. An inner panel, indicated generally at reference numeral 64 and shown in FIGS. 6 and 7, includes three sub-panels R, S, T, which are folded and stacked beneath flap F1 and attached to the inside surface of main panel N. Sub-panel R is attached to sub-panel S along fold line 42 and sub-panel S is attached to sub-panel T along fold line 44. Each sub-panel R, S and T contain a flap thereon. Each flap is integral with its corresponding sub-panel, is substantially square shaped and connected to the respective sub-panels along fold lines. Each of the flaps contained on each of the sub-panels has the pivot or fold line contained along a different side than each of the other flaps. For example, Flap F2 contained on sub-panel R contains a vertical fold line along a left side of flap F2; flap F3 contained on sub-panel T contains a vertical fold line along a right side of flap F3; and flap F4 contained on sub-panel S contains a horizontal fold line along a bottom edge of flap F4. Before being attached to the inside surface of main panel N, sub-panels are folded such that the sub-panels are configured in a stacked arrangement. Sub-panel T is folded along fold line 44 so that the inside surface of sub-panel T is in direct contact with the inside surface of sub-panel S. Next, sub-panel R is folded along fold line 42 such that the inside surface of sub-panel R is in direct contact with the outside surface of sub-panel T. The outside surface of sub-panel R is attached, adhesively or otherwise, to the inside surface of main panel N. The panels, sub-panels and flaps are now configured so that opening one flap reveals another flap, etc. In operation, when a user opens flap F1 by folding flap F1 downward along fold line 40, flap F2 is revealed. When flap F2 is opened by folding flap F2 to the right about fold line 46, flap F4 is revealed. Opening flap F3 by folding flap F3 to the left about fold line 50, reveals flap F4. When flap F4 is opened by folding flap F4 downward about fold line 48, the inside surface of main panel M is revealed, as shown in FIG. 4. A small tab 23, may be attached to flap F4, shown in FIGS. 3 and 4, to facilitate activation of a pull-string switch mechanism (described in further detail below) which is used to activate a sound clip or other special effect. Both the front and back surfaces of each flap may contain a printed message, a drawing, a picture or other printed indicia, which is revealed upon opening the various flaps. The inside surface of main panel M may also contain a printed message, a drawing, a picture or other printed indicia, which is revealed after all preceding flaps have been opened. The artwork on the main panels, sub-panels and flaps may be coordinated by theme or occasion. This greeting card configuration simulates opening nested boxes wherein opening one box leads to a smaller box, and so on.

While greeting card constructs have been described in detail herein, such descriptions are intended to describe certain or preferred embodiments. Variations to the number and position or orientation of various panels, flaps and fold lines and/or connection points have been anticipated and are considered to be within the scope of the present invention.

In addition to the various flaps revealing various printed messages or other entertaining indicia, the greeting cards may additionally contain electronic components which comprise a sound module operative to store and playback one or more digital audio files. The electronic components may include, but are not limited to: a printed circuit board 11, a microprocessor, a controller, a memory device, a speaker 25, a power source 15, one or more digital audio files contained on the memory device, and one or more sensors or switch mechanisms for initiating playback of the one or more digital audio files. Additional components which facilitate the production of sound or other special effects such as lights, video and moveable components upon the opening of one or more flaps contained on the greeting card body may be included as well and are considered to be within the scope of the present invention. The various electronic components are attached to the inside surface of one or more main greeting card panel. The components may be attached directly to the panel or may be attached to a substrate which is attached to a main greeting card panel. Two overlying panels may be attached around two or three side edges creating an internal cavity therebetween. The components are substantially or completely concealed within the cavity.

In a preferred embodiment, such as the embodiment shown in FIGS. 8 and 9 and described above, a slide switch 17 is located across a main fold line such that when the greeting card is opened by pivoting the card about said main fold line, playback of a first digital audio file is initiated. This first digital audio file may contain an introductory greeting that follows the theme or subject of the greeting card, such as a birthday greeting, a get well wish or a congratulatory phrase or expression. In addition to a verbal greeting, the first digital audio file may additionally contain a short audio prompt that instructs the user to open the one or more flaps contained on the greeting card to hear further audio messages. Thereafter, lifting each of the one or more flaps on the greeting card will initiate playback of a short audio message. The individual audio messages corresponding to each flap are initiated by lifting the flap. In a preferred embodiment, a pull string mechanism 19 having a pull string 21 attached along the fold line of each flap is used to initiate playback of a digital audio file. When a user opens the flap by pivoting the flap about the fold line, the pull string 21 is moved or pulled, thereby triggering playback of the corresponding audio file. In other alternative embodiments, the individual audio messages corresponding to each flap may be initiated by various methods including, but not limited to: a light sensor positioned beneath each flap such that when the flap is lifted, the light sensor is exposed to light, thereby triggering playback of the audio message; a magnetic sensor wherein for each flap, a first magnet is contained on the inside surface of the flap and a second magnet is contained underneath the flap, on the inside surface of the underlying greeting card panel so that when the two magnets are in contact with each other, the circuit is broken and when the two magnets are moved apart from each other, the circuit is complete, thereby triggering playback of the audio message; or a touch sensor placed beneath each flap which triggers playback of the audio message upon sensing a human touch or tap on the individual flaps. Each flap contains a different audio message. For example, each flap may be printed to look like a gift package or present. When the user "opens" the gift package by lifting the flap, the underlying panel contains a depiction of a gift that would be contained within the gift package, such as for example, a picture of a piece of jewelry or a box of chocolates. The individual audio files may be coordinated with the artwork or theme printed on and beneath each flap. Each individual audio file may continue to play when the flap is closed or it may be deactivated once the flap is closed. Also, a first audio message, triggered by lifting a first flap, may continue to play after the user lifts a second tab until the first audio message is exhausted or alternatively, the first audio message may be deactivated once the user lifts the second flap, triggering a second audio message. The pre-recorded audio files may contain a spoken verbal message, a musical clip, such as a popular song or themed music relating to the theme of the greeting card, or a sound effect, such as an animal sound. In an alternative embodiment, such as the embodiment shown in FIGS. 1 through 7 and described above, the greeting card may have a series of flaps located beneath one another such that once first flap is opened it reveals a second flap, once the second flap is opened it reveals a third flap, and so on. Individual audio messages may correspond to each flap and be initiated upon that flap being opened, or a single audio message may be initiated upon opening the last of a series of flaps, after all preceding flaps have been opened.

In another embodiment, the greeting card may further include a microphone and switch to initiate a recording session wherein a user may record one or more personal messages or greetings which will be played back upon opening the greeting card or upon opening one or more flaps. The digital storage device may be operative to store several different recorded messages which can be replayed in a specific or random order upon opening the greeting card and one or more flaps. Personal user-recorded messages or greetings may also be combined with pre-recorded messages or greetings contained upon the digital storage device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive greeting card comprising:

a greeting card body having at least three greeting card panels with two of the at least three panels forming a cavity therebetween;

a flap contained on one of the at least three greeting card panels;

a sound module operative to store and playback at least one digital audio file, the sound module located inside the cavity formed by two of the at least three greeting card panels;

a three-panel insert located beneath the flap, the three-panel insert having three sub-panels connected along two fold lines and arranged so that each of the three sub-panels are in a stacked arrangement, the three sub-panels each having a flap contained thereon, each flap being integral with its corresponding sub-panel;

a switch connected directly to the third flap;

wherein opening the flap contained on one of the at least three greeting card panels reveals a first flap on a first sub-panel, opening the first flap reveals a second flap on a second sub-panel, opening the second flap reveals a third flap on a third sub-panel, and opening the third flap initiates playback of the at least one digital audio file.

2. The interactive greeting card of claim 1, wherein the flap contained on the one of the at least three greeting card panels is larger than the flap located on the first, second and third sub-panels.

3. The interactive greeting card of claim 1, wherein the flaps decrease in size with the order in which they are opened.

4. The interactive greeting card of claim 1, wherein a front surface of each flap contains a printed message or picture contained thereon.

5. The interactive greeting card of claim 1, wherein each of the flaps reveal a portion of a single printed message.

6. The interactive greeting card of claim 1, wherein a pull string trigger attached to the third flap initiates playback of the at least one digital audio file upon opening the third flap.

7. The interactive greeting card of claim 1, wherein the flap contained on one of the at least three greeting card panels opens in a downward direction.

* * * * *